United States Patent [19]

Hatch

[11] 3,958,621

[45] May 25, 1976

[54] HORIZONTAL STACK MOLDING MACHINE

[75] Inventor: Edmond K. Hatch, Brecksville, Ohio

[73] Assignee: The Osborn Manufacturing Corporation, Cleveland, Ohio

[22] Filed: Oct. 10, 1972

[21] Appl. No.: 296,162

[52] U.S. Cl. ..... 164/173; 164/187; 164/207; 249/161; 214/1 BB

[51] Int. Cl.[2] ..... B22C 15/08

[58] Field of Search ..... 164/172, 173, 180, 187, 164/200, 207, 37; 425/450; 249/161; 214/1 BB, 8.5 R

[56] References Cited

UNITED STATES PATENTS

| | | | |
|---|---|---|---|
| 2,427,044 | 9/1947 | Burns | 425/450 X |
| 3,097,397 | 7/1963 | Leach et al. | 249/161 UX |
| 3,303,535 | 2/1967 | Rearwin et al. | 164/172 |
| 3,734,163 | 5/1973 | Larkin | 164/187 |
| 3,744,552 | 7/1973 | Lundsgart | 164/187 |

FOREIGN PATENTS OR APPLICATIONS

| | | | |
|---|---|---|---|
| 684,015 | 3/1965 | Italy | 214/8.5 R |

*Primary Examiner*—Ronald J. Shore
*Attorney, Agent, or Firm*—Donnelly, Maky, Renner & Otto

[57] ABSTRACT

A horizontal stack foundry molding machine having opposed high pressure horizontally aligned rams adapted to close and then move into the open ends of a mold box filled with sand to make a high quality sand mold, such box being formed by opposed L-shape parts, the L-shape part forming the lower side of the box being horizontally movable after the rams have been retracted to shift the mold formed in the box from between said rams to a position in alignment with a pouring conveyor, a pusher being provided to move such mold from the movable L-shape part onto the pouring conveyor into juxtaposition with previously formed molds to form the horizontal stack.

22 Claims, 15 Drawing Figures

92
190
184
182
215
211
206
201
207
214
212
204
203
202
205
232
208
209
189
220
221
186
197
231
185
198
188
229
230
225
228
199
222
223
224
183
181
187
117
22
195
218
192
226

HORIZONTAL STACK MOLDING MACHINE

This invention relates generally as indicated to a horizontal stack molding machine and method and more particularly to certain improvements in a machine of the type seen in the commonly owned copending application of Edward D. Abraham and Robert D. Shields entitled "Foundry Molding Machine", Ser. No. 134,200, now U.S. Pat. No. 3,838,731 filed Apr. 15, 1971.

Horizontal stack foundry molding machines form sand cakes which have pattern impressions in one or both ends thereof, such cakes being oriented vertically and placed in juxtaposition on a pouring conveyor to be moved past a pouring point, the molten metal being poured between the juxtaposed cakes. In order to obtain a high quality mold, it is desirable to employ horizontally aligned rams to press the opposite end faces of the cake to form mold faces of uniform high density. However, one of the problems which arises in such molding technique is known as "spring-back". This is a phenomenon wherein the sand mold actually physically expands albeit slightly when the mold is removed from the box or flask in which the mold cake is made. If the mold cake is ejected from the mold box by one of the pattern plates, the expansion of the mold can be sufficient actually to fracture the cake in the area of the pattern. This is particularly true when complex patterns are employed. This spring-back or expansion of the mold also can create some problems in proper horizontal alignment of the mold with other molds in the horizontal stack.

To overcome this spring-back and alignment problem, applicant has provided a horizontal stack molding machine utilizing a mold box formed by opposed L-shape parts. One part which is fixed includes a side wall of the mold box and the top wall through which the sand is blown into the box. The other part includes the bottom wall of the box and one vertical wall which is horizontally shiftable to transfer the mold cake after it is formed to a position in alignment with the horizontal stack. After transfer, a pusher then places the formed mold into juxtaposition with the previously formed mold in the horizontal stack. Horizontal shifting of the one L-shape part of the mold box also includes a mechanism for obtaining slight vertical movement of such part so that the movable L-shape part moves slightly diagonally with respect to the fixed L-shape part.

The machine of the present invention also incorporates horizontally aligned opposed rams to obtain high density and hardness on both faces of the mold cake with the patterns on such rams being readily changeable. The machine also incorporates a variety of other improvements such as a mold traction device to assist in the movement of the molds in the horizontal stack to facilitate proper pouring and subsequent cooling.

It is accordingly a principal object of the present invention to provide a horizontal stack molding machine providing dimensionally accurate mold cakes having mold cavity surfaces of uniform high hardness and density.

A further important object is the provision of a horizontal stack molding machine which avoids the spring-back problem.

Another object is the provision of such machine utilizing a movable L-shape section of the mold box to obtain shifting of the mold into proper registration with the horizontal stack, a pusher not engaging the patterned surfaces, then moving the mold cake into proper juxtaposition with the horizontal stack.

Yet another object is the provision of a horizontal stack molding machine of the type having opposed high pressure rams wherein the patterns on such rams can readily be changed.

Other objects and advantages of the present invention will become apparent as the following description proceeds.

To the accomplishment of the foregoing and related ends, the invention, then, comprises the features hereinafter fully described, the following description and the annexed drawings setting forth in detail a certain illustrative embodiment of the invention, this being indicative, however, of but one of the various ways in which the principles of the invention may be employed.

In said annexed drawings:

FIG. 7 is a top plan view partially broken away illustrating the pouring conveyor mold traction device;

FIG. 8 is a side elevation of the mold traction device as seen from the line 8—8 of FIG. 7;

FIGS. 10 through 15 are schematic figures illustrating the sequence of movement of the movable L-shape mold box portion in the closing of the mold box, the formation of the mold, and the transfer of the mold to a position in alignment with the pouring conveyor.

THE MACHINE — GENERAL ARRANGEMENT (FIGS. 1–3)

Figure 1:
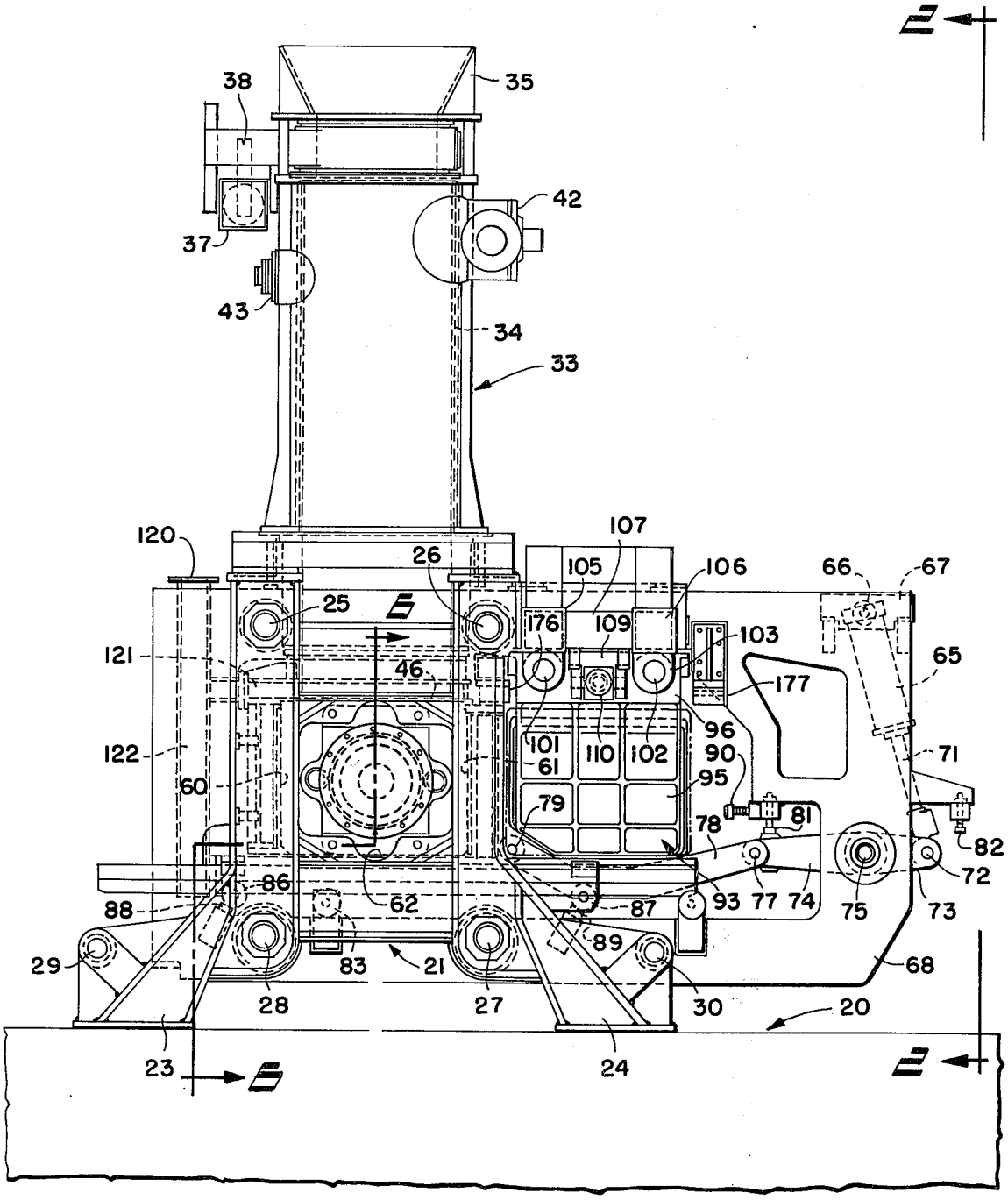
FIG. 1 is a front elevation of a machine in accordance with the present invention with the base therefor partially broken away.

The machine of the present invention is mounted on a base 20 and includes front and rear frames 21 and 22, each of which is provided with the spread legs seen at 23 and 24 in FIG. 1. Such frames are interconnected by four large tie rods 25, 26, 27 and 28. Additional interconnecting tie rods 29 and 30 may be provided on the outside of the spread legs 23 and 24 as seen in FIG. 1. The front and rear frames 21 and 22 support a top frame 32 which in turn supports a large blow reservoir 33. The blow reservoir is cylindrical and includes a perforated interior sleeve 34. The top of the reservoir is provided with a funnel 35 having a square top. The funnel facilitates the feeding of sand into the reservoir from a suitable conveyor or hopper.

Figure 2:
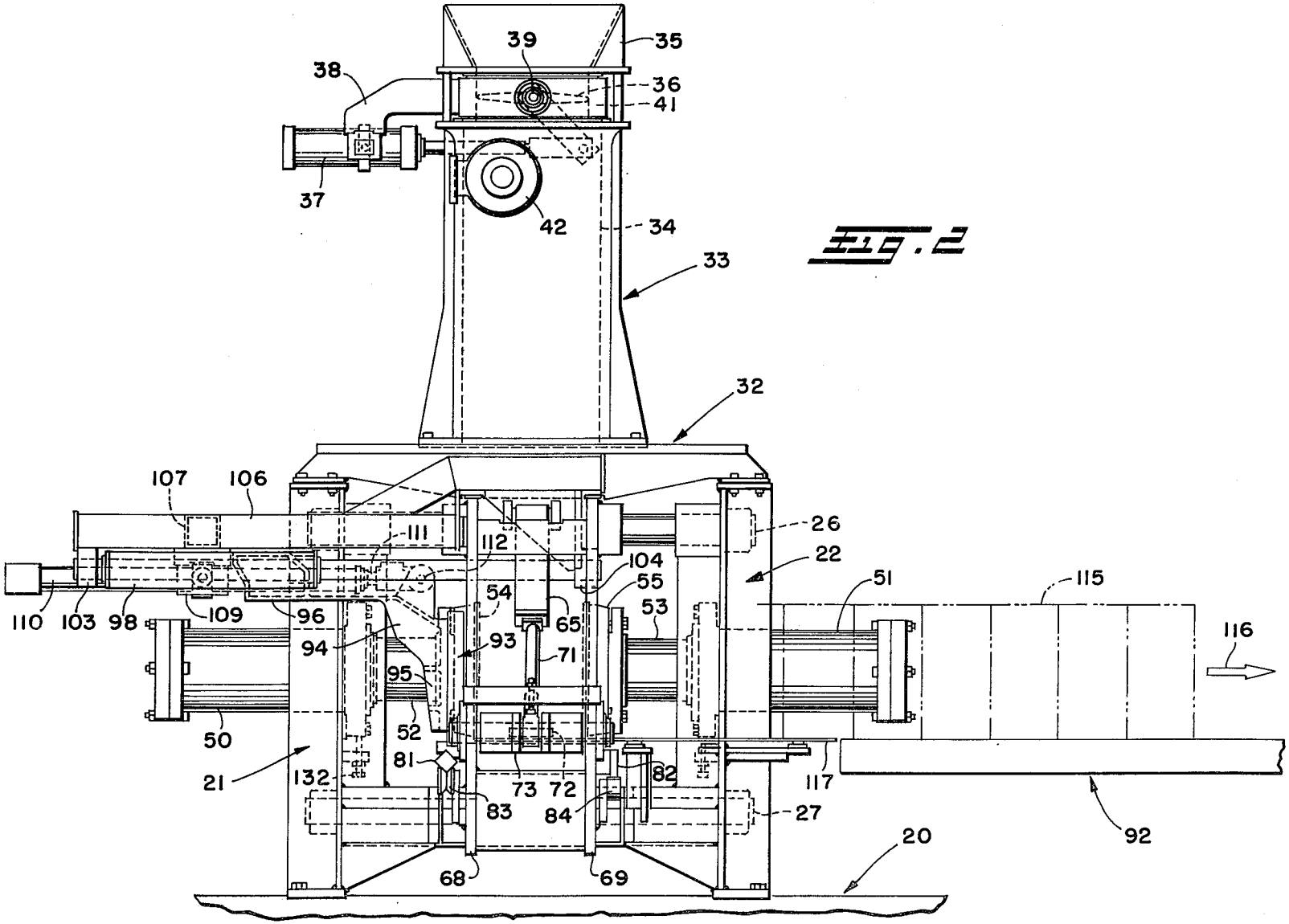
FIG. 2 is a side elevation of the machine seen from the line 2—2 of FIG. 1.

A relatively large butterfly valve member 36 is actuated by a pneumatic piston-cylinder assembly 37 mounted on bracket 38. In FIG. 2, the valve 36 is shown in its closed position and it can be seen by retraction of the piston-cylinder assembly 37, the valve member 36 will be rotated on its axis 39 to a vertical position to permit sand to be fed by gravity into the interior of the reservoir 33. Such valve may be of the type shown in U.S. Pat. No. 3,540,520 which in the closed position is provided with an inflatable annular seal 41. The sand blow reservoir is provided with a blow valve 42 and two exhaust valves 43.

Figure 6:
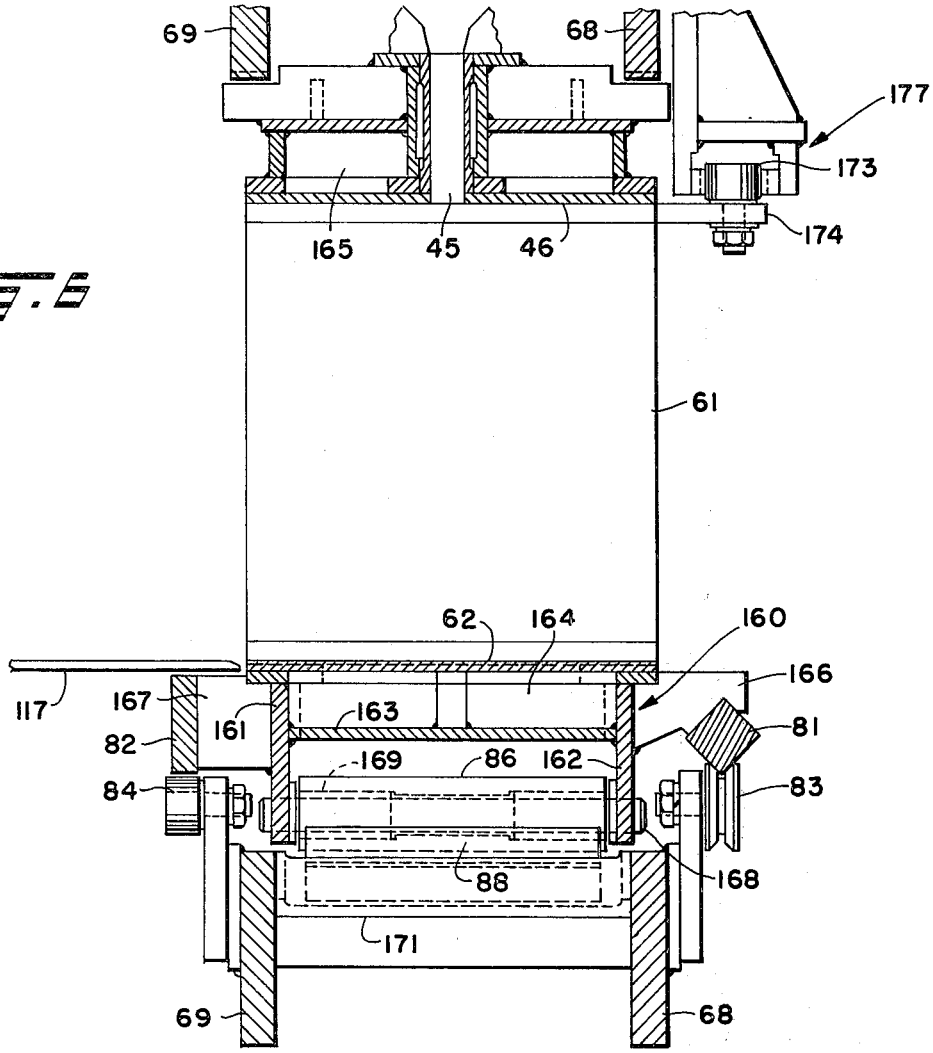
FIG. 6 is an enlarged vertical section taken through the mold box substantially on the line 6—6 of FIG. 1.

The lower end of the reservoir funnels into an elongated slot 45 which passes through the top wall 46 of the mold box which is seen in greater clarity in FIG. 6 and the schematic FIGS. 10 through 15. Accordingly, when the butterfly valve 36 is closed after the reservoir has been charged with sand, the opening of the blow valve 42 will fluidize the sand in the reservoir forcing it through the slot 45 into the mold box.

Mounted on the frames 21 and 22 are horizontally aligned opposed hydraulic squeeze piston-cylinders 50 and 51, the respective rods 52 and 53 supporting on their outer ends pattern squeeze heads 54 and 55, respectively. Such pattern squeeze heads form the opposed end walls of the mold box as sand is blown therein. Each squeeze head is provided with a pair of guide rods indicated at 56 and 57 to preclude rotation of the squeeze head with respect to its cylinder.

As indicated, the squeeze heads form the opposed end walls of the mold box while the top wall 46 and one side wall 60 are fixed. The opposite side wall 61 and the bottom wall 62 are movable as a unit on a horizontally movable carriage. Such carriage is operated for shuttling movement by hydraulic carriage piston-cylinder assembly 65, the blind end of which is pivoted at 66 to bracket 67 secured between frame plates 68 and 69. The rod 71 of the piston-cylinder assembly 65 is pivoted at 72 to the bifurcated end 73 of crank arm 74 which is pivoted at 75 between the frame plates 68 and 69. Pivotally connected at 77 to the opposite end of the arm is link 78 which is pivotally connected at 79 to the carriage. Adjustable stops 81 and 82 are provided for the crank arm adapted to engage the buttons indicated on the opposite side of the outer end thereof.

The carriage for the bottom and side mold box walls 61 and 62 includes two elongated rails 81 and 82, the former being of the diamond sectional configuration riding in V-rollers 83 while the latter rail 82 rides on cylindrical rollers 84. There are two such V-rollers 83 and two such cylindrical rollers 84, all of which are mounted on brackets on the frame plates 68 and 69.

In the center of the carriage frame, there is provided two can roller assemblies seen at 86 and 87 in FIG. 1 which, when the carriage is in the mold box closing position, engage fixed cams 88 and 89, respectively. As the carriage moves into its mold box closing position, the fixed cams will actually lift the carriage slightly and conversely when the mold box is opening, the carriage will drop slightly moving the wall 61 and the wall 62 diagonally away from the fixed walls 60 and 46.

Figure 3:
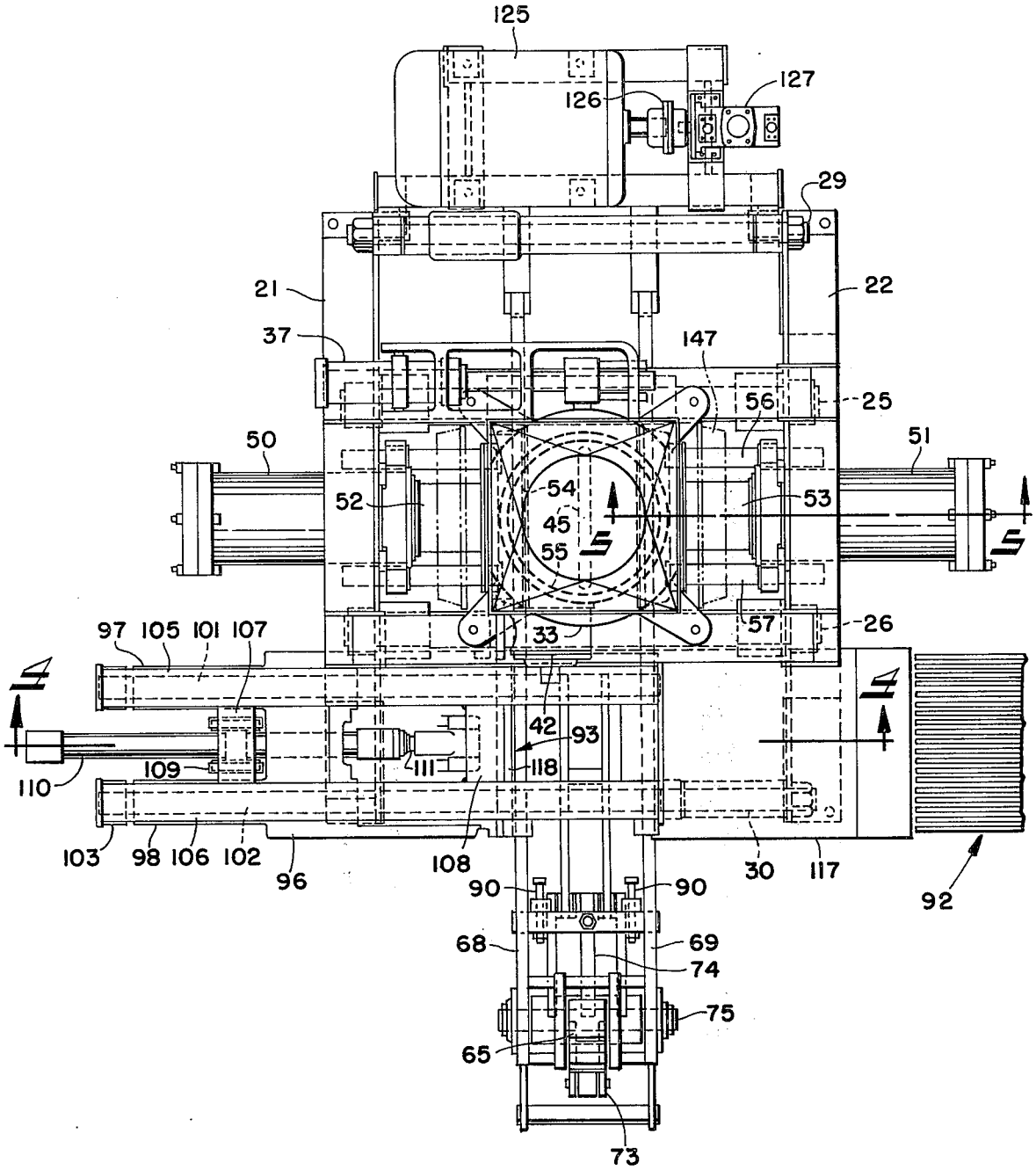
FIG. 3 is a top plan view of such machine with the horizontal stack conveyor broken away.

Adjustable stops 90 are provided as seen in FIGS. 1 and 3 which assure that the fixed walls 61 and 62 of the carriage are in proper alignment with respect to pouring conveyor 92 when the carriage is shifted to the right as seen in FIG. 1.

In such open position of the carriage, the mold cake supported on the bottom wall 62 will then be in direct alignment with the pouring conveyor 92 as well as with pusher 93 which in its retracted position is on the opposite side of the mold cake from the pouring conveyor. The pusher 93 includes a frame 94, the front portion 95 of which extends vertically while the top portion 96 extends horizontally between two cylinders 97 and 98 in which are suitable bushings supporting the pusher for sliding movement on guide rods 101 and 102, respectively.

Such guide rods are supported dependently by brackets 103 and 104 at each end, such brackets extending downwardly from frame mebers 105 and 106, respectively, which extend in cantilever fashion from the top of the frame plates 68 and 69.

The cantilever frame members 105 and 106 are interconnected by relatively short transverse frame members 107 and 108, the former having dependently mounted thereunder trunnion bracket 109 which supports pusher piston-cylinder assembly 110. The cylinder of such assembly extends through a suitable opening in the horizontal portion 96 of the pusher frame with the rod 111 of such assembly being connected at 112 to the pusher frame 94.

Figure 4:
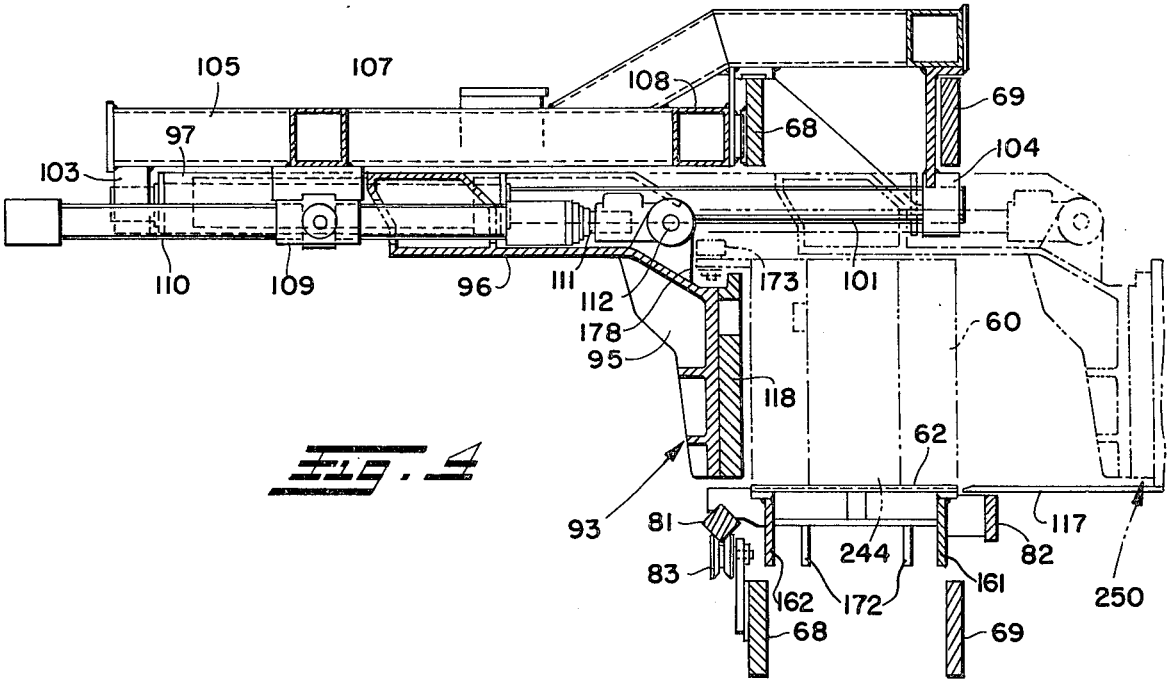
FIG. 4 is a fragmentary vertical section slightly enlarged taken on the line 4—4 of FIG. 3 illustrating the mold pusher and showing the same in phantom lines extended.

In the illustrated embodiment, the cylinder assembly 110 may have a substantial stroke as seen in FIG. 4 so that extension of such assembly will not only remove the mold cake from the carriage but will also cause the removed cake to engage the horizontal stack seen schematically at 115 in FIG. 2, and also move such stack in the direction of the arrow 116. The pusher piston-cylinder assembly 110 may also act in conjunction with a mold traction device hereinafter described to facilitate the horizontal movement of the stack along the pouring conveyor 92 past the pouring point.

As seen in FIG. 3, the pouring conveyor 92 may itself comprise a series of horizontal bars. Between the carriage and the pouring conveyor, there is provided a bridge plate 117 onto which the sand cake is slide from the bottom wall 62 of the carriage.

The pusher 93 may be provided with a removable front plate 118 which may have suitable cutouts or apertures seen in FIG. 4 so as to avoid direct contact with any patterned portion of the sand cake. In this manner, damage to the patterned cavity in the face of the sand cake may be avoided.

In order effectively to blow sand into the mold formed by the walls 46, 60, 61 and 62, such walls are normally each provided with a plurality of vents which trap the sand while permitting air to escape. Such air may escape through exhaust port 120 seen in FGI. 1. The exhaust port 120 is in communication with passages 121 and 122 which are in turn in communication with manifold chambers back of each of the walls 46 and 60, respectively. The walls 61 and 62 of the movable carriage in the clamped position may also be provided with such manifold chambers also connected to the passages 121 and 122, respectively. In this manner all of the blow air will escape through the port 120. It will of course be appreciated that a separate exhaust port may be provided for the vents in the walls 61 and 62, if desired.

As seen in FIG. 3 the machine is provided with a motor 125, the drive shaft of which is connected through coupling 126 to hydraulic pump 127. The motor and pump operate the various hydraulic piston-cylinder assemblies of the machine including of course the opposed squeeze piston-cylinder assemblies. The motor and pump may be provided at any suitable location with respect to the machine.

THE SQUEEZE PISTON-CYLINDER ASSEMBLIES

Figure 5:
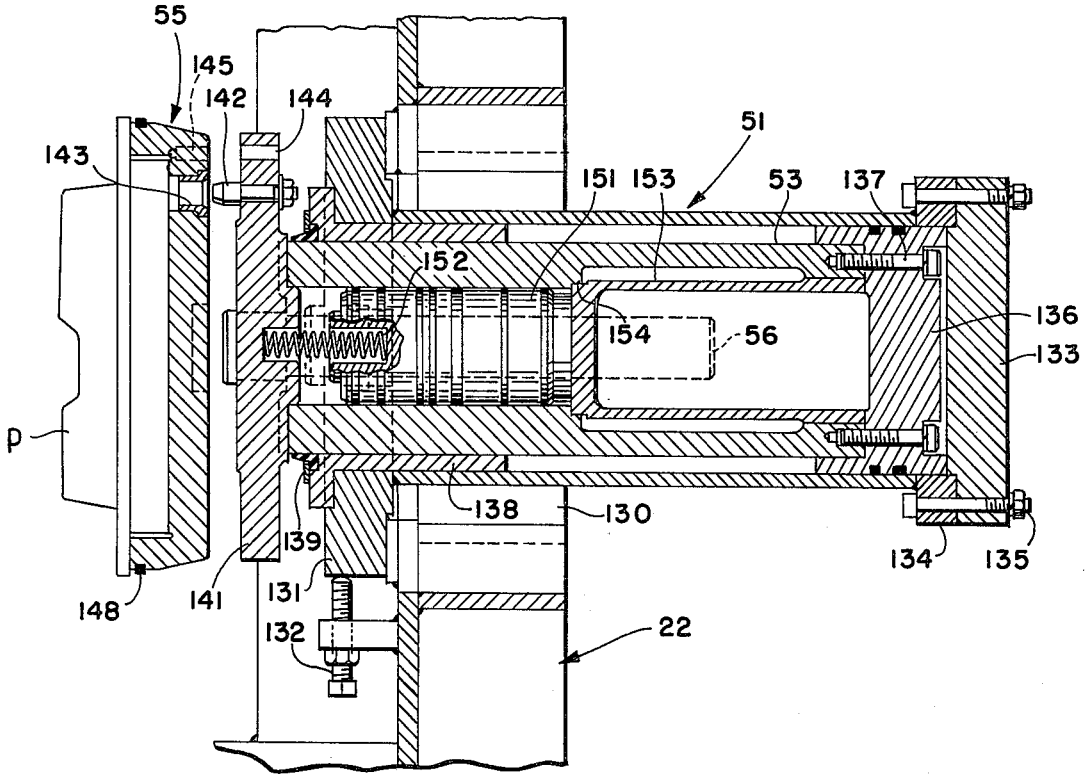
FIG. 5 is an enlarged vertical section taken on the line 5—5 of FIG. 3 illustrating one of the squeeze rams with the pattern and stool therefor shown disassembled.

Referring now more particularly to FIG. 5 it will be seen that the squeeze piston-cylinder assembly 51 is mounted in the frame 22 and extends through window 130. The rod end of the cylinder includes a relatively large adapter 131 which may be vertically positioned and secured in place, adjusting screw 132 assisting in the vertical positioning thereof. The cylinder includes a blind end cap 133 secured to cylinder flange 134 by the fasteners indicated 135. The rod 53 of the assembly has secured thereto a piston 136 by the fasteners indicated at 137. The rod extends through sleeve bushing 138 which is provided with wiper assembly 139.

Secured to the end of the rod is a rectangular plate or head 141 to which are secured the guide rods 56 and 57 which extend through suitable bushings in projections on the adapter 131. The head 141 is provided with one or more locating pins 142 which fit within bushings 143 in the squeeze head 55. In this manner the squeeze head is readily located and positioned on the head 141 and suitable fasteners extending through the apertures 144 in head 141 and threaded in the apertures 145 in the squeeze head may be employed to secured the squeeze head firmly in place.

A threaded socket may be provided in the top of the squeeze head to which a lifting eye may readily be secured so that when the piston-cylinder assembly is fully retracted as indicated in FIG. 5, a squeeze head may readily be unfastened and removed from the machine through the clearance provided by the fantom line position 147 of the squeeze head seen in FIG. 3. Each squeeze head is provided with a pattern P and a suitable peripheral seal 148 which will preclude the escape of sand as the mold box is filled during the blow.

The rod 53 is hollow as seen in FIG. 5 and in the forward end thereof accommodates a reciprocable vibrating ram 151. A compression spring 152 normally urges the ram against cylindrical spacer 153 which extends between the shoulder 154 and the piston 136. The vibrating ram may be utilized both during squeeze to assist in the compacting of the mold as well as during the draw to facilitate the removal of the pattern from the mold cake. Air pressure supplied between the spacer and the ram will normally cause the ram to move to the left as seen in FIG. 5 uncovering an exhaust port whereupon the spring causes the ram to rebound against the spacer. This operation is repeated as desired.

THE MOLD BOX CARRIAGE

The mold box carriage is seen in somewhat greater detail in FIG. 6 and includes a supporting frame 160 for the bottom wall 62 and the upstanding side wall 61. The supporting frame includes the two vertical plates 161 and 162 which are interconnected by plate 163 forming chamber 164 manifolding the vent ports in the bottom mold wall 62. FIG. 6 also shows the similar manifolding chamber 165, which chamber is connected to the passage 121 which leads to the exhaust port 120 seen in FIG. 1. Laterally projecting ears 166 and 167 support the rails 81 and 82, respectively.

Extending between the frame plates 161 and 162 is shaft 168 supporting cam roller 86 on bushings indicated at 169. As the carriage moves toward the viewer in FIG. 6 to close the mold box, cam roller 86 engages the fixed cam 88 which is supported on the transverse frame 171 extending between the frame plates 68 and 69 slightly to elevate the bottom and side walls of the mold box. The parallelism of the fixed cams 88 and 89 together with the roller assemblies 86 and 87 assures that the bottom wall will remain level and the side wall vertical in the final position. It is noted that the roller assembly 87 is actually two laterally spaced rollers supported by similar shafts and bushings from the frame plates 161 and 162 and laterally spaced depending ears 172 seen in FIG. 4. This provides clearance for the link 78 therebetween.

To provide lateral stability th side wall 61 has projecting therefrom a guide roller 173 mounted on arm 174. At the extreme positions of the carriage the roller engages guide clevices 176 and 177 to insure lateral stability of the mold walls 61 and 62 both during squeeze as the rams enter the mold box and during pushoff as the mold cake is moved across the bridge plate 117 by the pusher 93. As seen in FIG. 4 the pusher is provided with a suitable clearance as indicated at 178 for the laterally projecting roller 173 on the carriage.

MOLD TRACTION DEVICE

Figure 9:
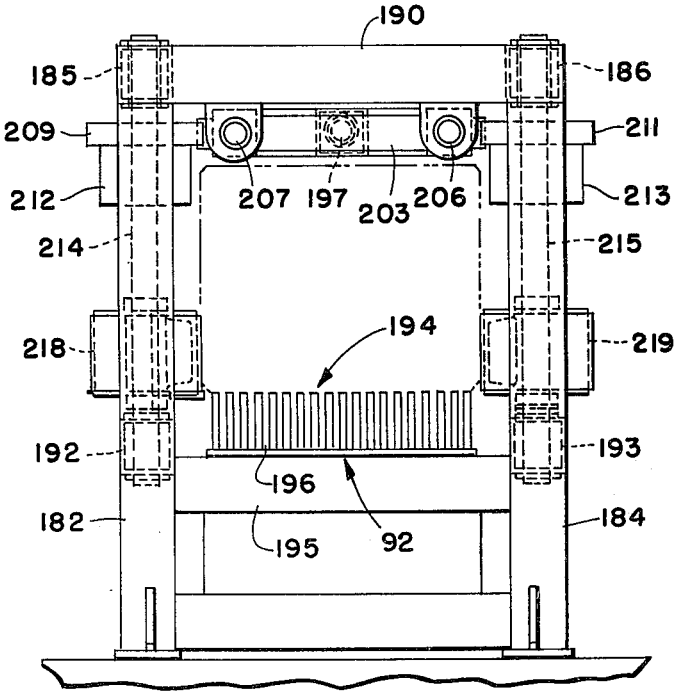
FIG. 9 is an end elevation of the mold traction device as seen from line 9—9 of FIG. 8.

Referring now to FIGS. 7, 8 and 9 it will be seen that the mold traction device includes four upstanding legs 181, 182 183 and 184, the first two being on one side of the pouring conveyor 92 while the last two are on the opposite side. Top longitudinal frame members 185 and 186 extend between the tops of the legs on each side of the conveyor. Transverse frame members 187, 188, 189 and 190 extend between the longitudinals 185 and 186. Additional longitudinal frame members 192 and 193 extend between the legs at each side of the conveyor 92 just below the top surface 194 of the pouring conveyor 92. An additional transverse support 195 may be provided between the front legs 182 and 184 assisting in the support of the vertically extending horizontal bars 196 which form the pouring conveyor.

A hydraulic piston-cylinder 197 has its rod 198 secured to bracket 199 depending from the transverse frame 188. The blind end of the piston-cylinder assembly is connected to frame 201 which comprises transverse members 202 and 203 interconnecting cylinders 204 and 205. Such cylinders are mounted for sliding movement on longitudinally extending rods 206 and 207 which are dependently supported from brackets extending from the transverse members 189 and 190.

Each cylinder on its lateral exterior is provided with a rack as indicated at 208 and 209. The racks 208 and 209 are in mesh with pinions 211 and 212, respectively, which are mounted on overrunning cam clutches 212 and 213, respectively, which are in turn secured to vertically extending shafts 214 and 215 which are journaled top and bottom in the longitudinally extending frame members at each side of the pouring conveyor. The construction of the pinions and clutches is such that the shafts 215 and 214 will rotate counterclockwise and clockwise, respectively, as the piston-cylinder assembly 197 is extended but will not rotate at all as such piston-cylinder assembly is retracted.

Secured to each of the vertically extending shafts 215 and 214 is a pulley as seen at 218 and 219 in FIG. 9. Entrained about each such pulley is a friction drive belt as seen at 220 and 221, the opposite end of each belt being entrained around idler pulleys seen at 222 and 223, respectively. Such idler pulleys are mounted on shafts 224 and 225, respectively, which are journaled in the lower longitudinal frame members and brackets 226 projecting from the legs 181 and 183.

The belt 221 on one side of the pouring conveyor is provided with a fixed backup seen at 228 while the belt 220 on the opposite side is provided with backup 229 which is adjustably supported from the three upstanding brackets 230, 231 and 232 on the longitudinal 192. The backup 229 is not only adjustable horizontally but is also slightly spring-loaded to exert a desired drive belt backup pressure forcing the drive belt against the side of the stack of sand mold cakes on the pouring conveyor 92.

It is believed apparent that the piston-cylinder assembly 197 which operates hydraulically in synchronism with the pusher piston-cylinder assembly 110, i.e. the outlet of the pusher piston-cylinder assembly is hydraulically connected to the inlet of the mold traction device piston-cylinder assembly 197, extends the frame 201 causing the drive belts 221 and 220 to move to assist a horizontal stack of sand cakes in moving to the right as seen in FIGS. 7 and 8. This relatives the interface pressure between the adjacent sand cakes in the stack and avoids undue pressure and pressure concentrations which may cause the sand cakes to crack or crumble.

OPERATION

Figure 10:
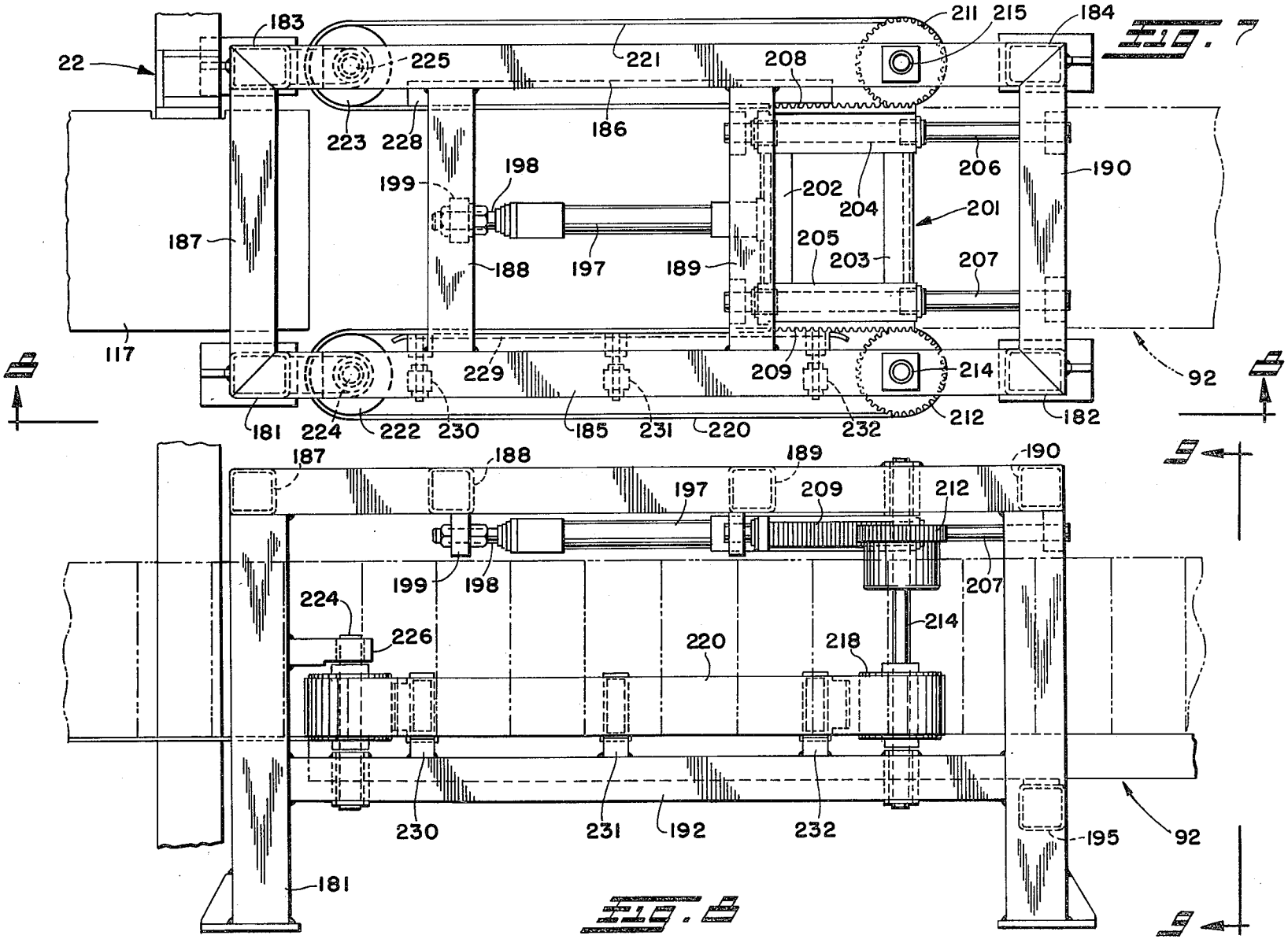
Figure 11:
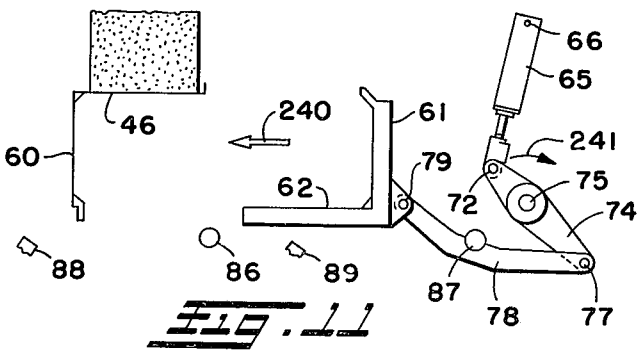
Figure 12:
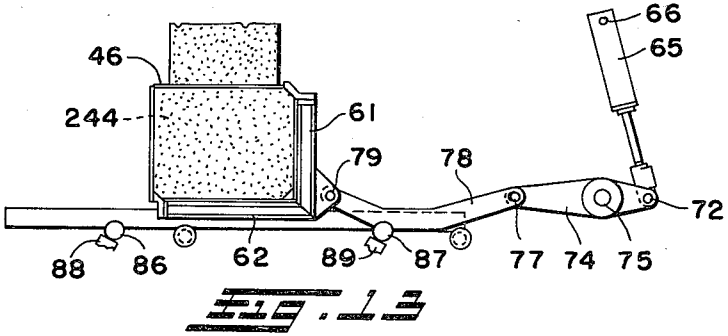
Figure 13:
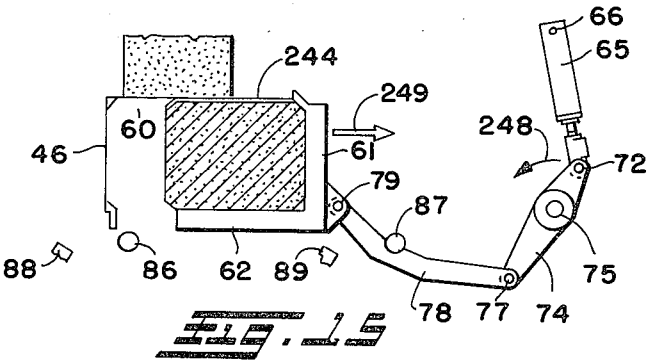
Figure 10:
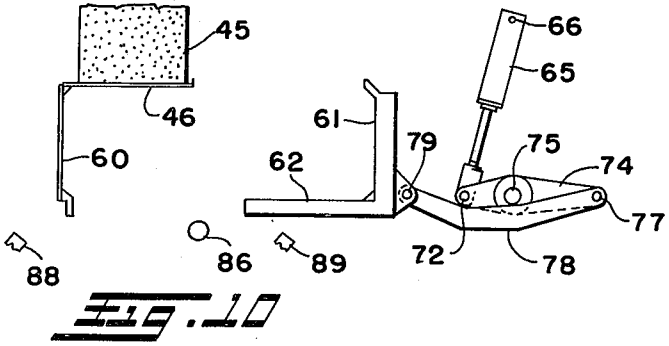
Figure 12:
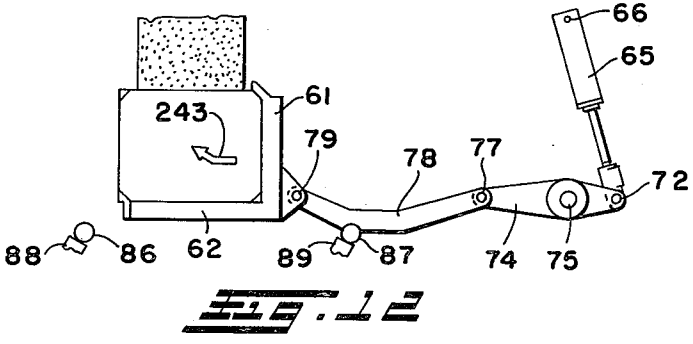

Referring now additionally to FIGS. 10 through 15 and initially FIG. 10 it will be seen that the carriage is in its retracted position with the bottom wall 62 and the side wall 61 in the proper alignment with respect to the pouring conveyor. Now initially with retraction of the piston-cylinder assembly 65 and the rotation of the crank arm 74 about its axis 75 as seen in FIG. 11, the carriage moves to the left as indicated by the arrow 240 in FIG. 11 as the piston rod pivot 72 swings to the right as seen by the arrow 241. As the pivot 72 passes over center between the line between pivots 75 and 66, extension of the piston-cylinder assembly 75 causes the carriage to move to extreme closed position as seen in FIG. 12 with the final movement of the carriage being slightly upwardly as indicated by the arrow 242, such final upward movement being caused by the cam roller assemblies 86 and 87 engaging the fixed cam members 88 and 89, respectively. In this position the mold box has now been formed, the two end walls in line with the viewer in FIG. 12 being closed by the squeeze heads 54 and 55 as seen in FIGS. 2 and 3. With the mold thus closed and the sand reservoir filled with sand, after the butterfly valve 36 is closed and sealed, the blow valve 42 is opened forcing sand from the reservoir into the mold box through the slot 45 to form the sand cake 244. During the blow, there will be considerable pressure exerted on the carriage which will normally tend to open the carriage but the position of the piston 77 either in line or slightly over center creates a toggle action effectively locking the carriage in its mold box closing position. At this point the squeeze heads 54 and 55 now extend under hydraulic pressure compacting the sand cake 244 to the approximate thickness seen in FIG. 4. As soon as the squeeze operation is completed the squeeze heads retract drawing the patterns from the mold while the latter is still retained on all four sides by the mold box. The patterns are drawn to a position clear of the molds such as seen at 147 in FIG. 3.

Figure 14:
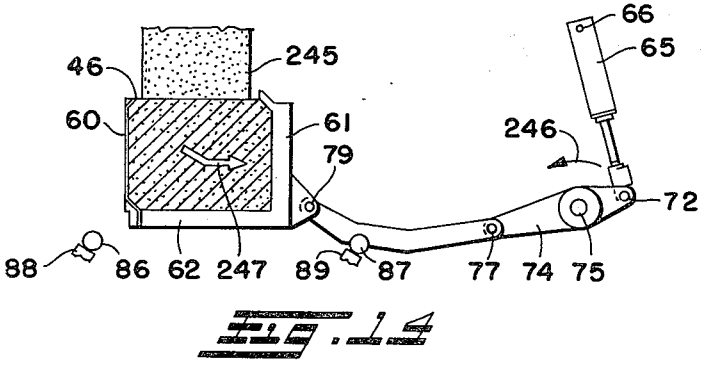

Referring now to FIG. 14 the sand cake 244 is stripped from the top wall 46 and the side wall 60 breaking away from the uncompressed sand 245 in the vertical slot 45 as the piston-cylinder assembly 65 is retracted swinging the arm 74 about the pivot 75 as indicated by the arrow 246. This causes the mold to move initially downwardly and then to the right as indicated by the arrow 247. Spring-back or mold expansion will take place at this point while the patterned faces of the mold are clear of or free from the patterns on the squeeze head. Accordingly, no damage to the pattern faces of the mold cake 244 will result. Continued retraction and then extension of the piston-cylinder assembly 65 swinging the pivot 72 in the direction of the arrow 249 will index the carriage and thus the sand cake 244 to a position in proper alignment with respect to the pouring conveyor 92. When the carriage is in the FIG. 10 position with the mold cake thereon the piston-cylinder assembly 110 of the pusher 93 is extended pushing the mold cake 244 from the mold box walls 61 and 62 onto the bridge plate 117 to the fantom line position 250 seen in FIG. 4.

Extension of the pusher of course also simultaneously and in synchronism operates the mold traction device so that the entire horizontal stack of molds on the pouring conveyor will move to the right with not all of the motive force thereof being supplied by the pusher 93. The mold cakes on the pouring conveyor will thus be indexed one mold per cycle of the machine past a suitable pouring point wherein molten metal is poured through suitable openings into the mold cavities formed between adjacent or juxtaposed sand mold cakes. In the extended position of the pusher as seen at 250 in FIG. 4 the carriage is then clear and will move back to the mold closing position as seen in FIG. 11. When the mold is closed as in FIG. 12 and being filled with sand, the pusher will then retract to the full line position seen in FIG. 4 to await the arrival of the next mold cake.

It can now be seen that there is provided a horizontal stack molding machine and method which avoids the spring-back or mold expansion problems and yet still provides accurate alignment of the successively formed mold cakes. In addition, the mold is rammed from each side providing both faces with the desired high density and hardness. The configuration of the pusher and carriage permits the two to proceed through a cycle of operation simultaneously thus increasing the efficiency of the machine while the pusher and the mold traction device facilitates the transfer of a large number of mold cakes along the pouring conveyor without damage to the molds.

I claim:

1. A horizontal stack foundry molding machine comprising an open ended box, means to close the open ends of said box and form a mold therein, said box comprising a stationary top and side wall, mans to horizontally move the opposite side and bottom wall, and means to maintain said bottom wall in a position to support such mold during its course of horizontal movement.

2. A machine as set forth in claim 1 including means to raise and lower said opposite side and bottom wall as the latter is moved adjacent the stationary top and side wall.

3. A machine as set forth in claim 1 wherein said means to move the opposite side and bottom wall comprises a carriage operative in one position to close said box and in another position to place a mold formed therein in alignment with a horizontal pouring conveyor.

4. A machine as set forth in claim 1 wherein said stationary top wall includes an elongated slot through which sand enters said box to form a mold cake.

5. A machine as set forth in claim 1 wherein said means to move the opposite side and bottom wall comprises a piston-cylinder assembly, a crank arm connected thereto, and a link connected between said walls and said crank arm.

6. A machine as set forth in claim 1 wherein said means to close the open ends of the box comprises hydraulically operated squeeze rams adapted to move into the open ends of said box to ram a sand cake therein.

7. A machine as set forth in claim 1 including a pouring conveyor extending normal to the movement of said opposite side and bottom wall, and pusher means operative to remove a sand cake therefrom to place the same in juxtaposition with a stack of sand cakes on said pouring conveyor.

8. A machine as set forth in claim 1 wherein said means to move the opposite side and bottom wall comprises the toggle linkage operative to lock said opposite side and bottom wall in position against said stationary top and side wall.

9. A machine as set forth in claim 1 including guide means for said opposite side wall operative to lock the same in vertical alignment at each extreme of movement of the opposite side and bottom wall.

10. A horizontal stack foundry molding machine comprising an open ended box, means to form a foundry mold in said box, and means to shift the bottom and one side wall only of said box laterally to move the mold into alignment with a support for a horizontal stack of such molds.

11. A machine as set forth in claim 10 wherein said means to shift the bottom and one side wall only comprises a carriage, and means to raise and lower said carriage as the same moves adjacent the other walls of said box.

12. A machine as set forth in claim 10 wherein said means to form a foundry mold in said box includes means to blow sand within such box and squeeze the sand through the open ends thereof to form said foundry mold.

13. A machine as set forth in claim 9 wherein said means to form a foundry mold in said box includes means to blow sand within such box, and opposed hydraulic rams adapted to extend through the open ends of said box to form a foundry mold therein.

14. A machine as set forth in claim 10 including pusher means operative to shift such mold from the bottom and one side wall of said box when the latter are in a position in which the mold is in alignment with the horizontal stack to place such mold at the end of such horizontal stack.

15. A foundry molding machine comprising an open ended box having a top, bottom and side walls, means to form a foundry mold in said box by moving a ram into at least one end of said box, and means to open said box after said ram has been retracted by moving the bottom and one side wall diagonally away from the opposite walls, and means to shift said mold horizontally after said box is opened.

16. A machine as set forth in claim 15 including a horizontally extending pouring conveyor, said last mentioned means placing the mold in alignment with said conveyor, and pusher means operative to place the mold at the end of a stack of horizontally extending molds on said conveyor.

17. A machine as set forth in claim 16 including a mold traction device opertive in conjunction with said pusher means to relieve the interface pressure between the molds on said pouring conveyor as said pusher forces said molds and the stack along said conveyor.

18. A machine as set forth in claim 15 wherein said means to shift said mold horizontally comprises a carriage supporting the bottom and one side wall of the mold box.

19. A foundry molding machine comprising an open ended box having a top, bottom and side walls, means to ram a foundry mold in said box by moving a ram into at least one end of said box, means to open said box after said ram has been retracted by moving the bottom and one side wall diagonally away from the opposite walls, and means to shift said mold horizontally after said box is opened, said means to open said box after said ram has been retracted by moving the bottom and one side wall diagonally away from the opposite walls comprising a fixed cam and roller means, said fixed cam extending in the direction of diagonal movement desired.

20. A foundry molding machine comprising an open ended box having a top, bottom and side walls, means to ram a foundry mold in said box by moving a ram into at least one end of said box, means to open said box after said ram has been retracted by moving the bottom and one side wall diagonally away from the opposite walls, and means to shift said mold horizontally after said box is opened, said means to shift said mold horizontally comprising a carriage supporting the bottom and one side wall of the mold box, said means to open said box after said ram has been retracted comprising roller means on said carriage and fixed cam means operative diagonally to raise and lower said bottom and one side wall of said mold box.

21. A machine as set forth in claim 20 wherein said carriage is moved by a piston-cylinder assembly rotating a crank arm, and link means interconnecting said crank arm and said carriage.

22. A horizontal stack foundry molding machine comprising an open ended box, means to close the open ends of said box and form a mold therein, said box comprising a stationary top and side wall, means to horizontally move the opposite side and bottom wall, means to maintain said bottom wall in a position to support such mold during its course of horizontal movement, and means to raise and lower said opposite side and bottom wall as they move adjacent the fixed top and side wall, said last mentioned means comprising fixed cams and movable rollers, said rollers being mounted for movement with the opposite side and bottom wall.

* * * * *